US005151631A

United States Patent [19]

Oda et al.

[11] Patent Number: 5,151,631

[45] Date of Patent: Sep. 29, 1992

[54] LIGHTING CIRCUIT FOR VEHICULAR DISCHARGE LAMP

[75] Inventors: Goichi Oda; Atsushi Toda; Soichi Yagi; Hiroki Shibata, all of Shimizu, Japan

[73] Assignee: Koito Manufacturing Co., Ltd., Tokyo, Japan

[21] Appl. No.: 760,420

[22] Filed: Sep. 16, 1991

[30] Foreign Application Priority Data

Oct. 19, 1990 [JP] Japan ..... 2-281324

[51] Int. Cl.[5] ..... H05B 37/00; B60Q 1/02

[52] U.S. Cl. ..... 315/127; 315/82; 315/308; 307/10.8; 340/641

[58] Field of Search ..... 315/127, 82, 308, 77, 315/83; 307/10.8, 10.1; 340/641, 636

[56] References Cited

U.S. PATENT DOCUMENTS 3,474,296 10/1969 Rickey ..... 315/77
3,585,453 6/1971 Kawai ..... 307/10.8
3,706,006 12/1972 Miller ..... 315/83
3,999,100 12/1976 Dendy et al. .
4,039,897 8/1977 Dragoset .
4,121,136 10/1978 Fournier et al. .
4,206,385 6/1980 Wisbey .
4,207,500 6/1980 Duve et al. .
4,232,383 11/1980 Chihara ..... 340/641 X
4,240,009 12/1980 Paul .
4,337,418 6/1982 Waltz .
4,450,384 5/1984 Krokaugger .
4,667,129 5/1987 Papillon ..... 315/82
4,667,131 5/1987 Nilssen .
4,724,360 2/1988 Luuresema .
4,763,044 8/1988 Nuckolls et al. .
4,766,350 8/1988 Husgen et al. .
4,797,599 1/1989 Frence et al. .
4,904,907 2/1990 Allison et al. .
4,914,355 4/1990 Mertens et al. .
4,992,702 2/1991 Shimizu et al. .

FOREIGN PATENT DOCUMENTS 4002334 1/1990 Fed. Rep. of Germany .
4017415 5/1990 Fed. Rep. of Germany .

*Primary Examiner*—Eugene R. LaRoche
*Assistant Examiner*—Son Dinh
*Attorney, Agent, or Firm*—Sughrue, Mion, Zinn, Macpeak & Seas

[57] ABSTRACT

A lighting circuit for a vehicular discharge lamp for lighting a discharge lamp using a DC power supply, comprises an OFF state detector, a DC input voltage detector and a power cutoff means. The OFF state detector detects an OFF status of a discharge lamp. The DC input voltage detector detects if a DC input voltage is within a predetermined range. The power cutoff means inhibits power supply to the discharge lamp when the OFF status of the discharge lamp is detected by the OFF state detector and the DC input voltage lying off the predetermined range is detected by the DC input voltage detector, and permits power supply to the discharge lamp upon reception of a signal indicating that the DC input voltage has returned within that range.

10 Claims, 8 Drawing Sheets

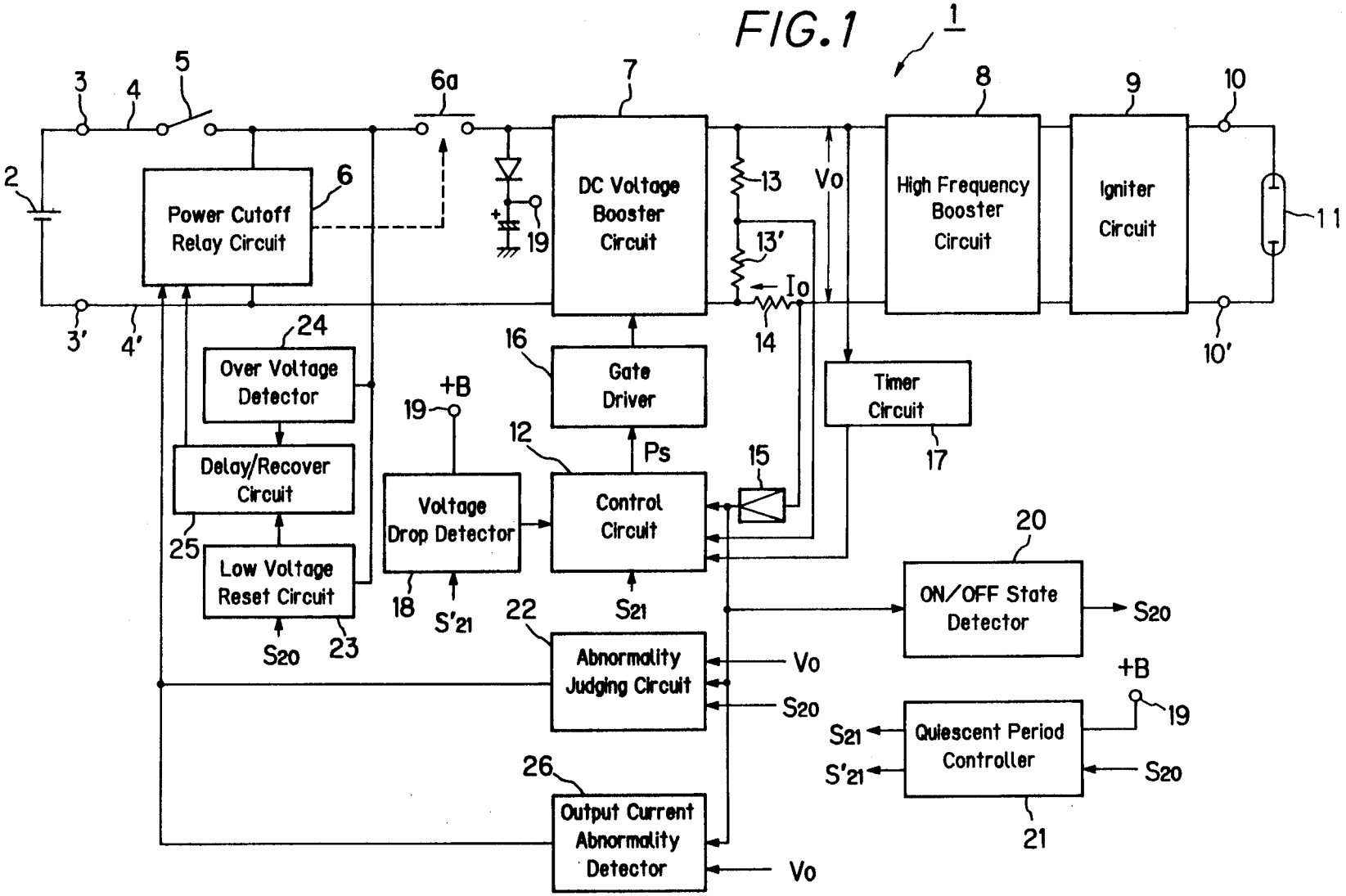
FIG. 1
1
2
3
3'
4
4'
5
6
6a
7
8
9
10
10'
11
12
13
13'
14
15
16
17
18
19
20
21
22
23
24
25
26
Igniter Circuit
High Frequency Booster Circuit
DC Voltage Booster Circuit
Power Cutoff Relay Circuit
Timer Circuit
Gate Driver
Control Circuit
Voltage Drop Detector
ON/OFF State Detector
Quiescent Period Controller
Abnormality Judging Circuit
Output Current Abnormality Detector
Over Voltage Detector
Delay/Recover Circuit
Low Voltage Reset Circuit
Vo
Io
Ps
S20
S21
S'21
+B Trigger Pulse Generator
Gate Driver

LIGHTING CIRCUIT FOR VEHICULAR DISCHARGE LAMP

BACKGROUND OF THE INVENTION

1. Field of the Invention

The present invention relates to a novel lighting circuit for a vehicular discharge lamp. More specifically, this invention pertains to a novel lighting circuit for a vehicular discharge lamp which ensures protection against a variation in DC input voltage, as well as temporarily inhibits power supply to the discharge lamp in response to a temporary change in DC input voltage, and restarts power supply to the discharge lamp when the DC input voltage returns within a predetermined range.

2. Description of the Related Art

Recently, some circuit protection measure is taken against a variation in voltage of a battery serving as a power supply for lighting a compact metal halide lamp which has been receiving attention as a light source for automobiles.

This protection measure is taken to prevent the unstable lighting of the lamp due to a change in battery voltage and malfunction of the lighting circuit. As an example of the protection means, a battery voltage detector and a power cutoff circuit (comprising a relay, etc.) are provided so that power supply to the lamp is stopped when the voltage variation does not fall within a range which ensure the normal operation.

The inhibition of power by the power cutoff circuit continues unless a lighting switch is set on again.

According to the conventional lighting circuit, the above protection measure functions as expected when a continuous abnormal status of the battery voltage happens. However, the protection measure also cuts off power supply to the lamp in response to a temporary change in battery voltage. When the battery voltage immediately returns to the allowable range, the lamp will be kept off.

From a viewpoint of safe driving at night, the lamp being switched off for each temporary change in battery voltage and this OFF status being kept until the lighting switch is set on again means that a driver should drive a car in the dark at his or her own's risk. In other words, it is desirable that the lamp be lit again as much as possible when a change in battery voltage is temporary and does not influence at all on relighting the lamp.

FIG. 8 is a diagram for explaining this situation. In the diagram, "$V_B$" denotes the battery voltage, "$\Delta V_L$" a variation range for the lower limit of the battery voltage, and "$\Delta V_H$" a variation range for the upper limit thereof. "$V_L$" indicates the center level of $\Delta V_L$ while "$V_H$" indicates the center level of $\Delta V_H$. These variations would occur as variation in produced lamps and lighting devices.

In view of the variations, it is necessary to set the lower and upper limits ($V^*_L$ and $V^*_H$, respectively) of the allowable range of the battery voltage $V_B$ as follows:

$$V^*_L = V_L + \Delta V_L/2$$

$$V^*_H = V_H - \Delta V_H/2$$

The allowable range $\Delta V_B$ for $V_B$ will therefore be:

$$\Delta V_B = V_H - V_L - (\Delta V_L + \Delta V_H)/2$$

The time chart illustrated below the range in FIG. 8 shows the operational status of the power cutoff circuit: "OFF" indicates the disabled state of the power cutoff circuit or power supply to the lamp being allowed, and "ON" represents the power supply to the lamp being inhibited by activation of the power cutoff circuit.

As illustrated, when the battery voltage $V_B$ gradually falls from within the range of $V^*_L \leqq V_B \leqq V^*_H$ down to $V_B = V^*_L$ at point P, power supply to the lamp is stopped. The power supply to the lamp will not be done even when $V_B$ returns later to the range of $V^*_L \leqq V_B \leqq V^*_H$, passing point Q ($V_B = V^*_L$).

SUMMARY OF THE INVENTION

It is therefore an object of the present invention to provide a lighting circuit for a vehicular discharge lamp, which can overcome the above problems.

To achieve the object, according to the present invention, there is provided a lighting circuit for a vehicular discharge lamp for lighting a discharge lamp using a DC power supply, which comprises an OFF state detector for detecting an OFF status of a discharge lamp, a DC input voltage detector for detecting if a DC input voltage is within a predetermined range, and a power cutoff means for inhibiting power supply to the discharge lamp when the OFF status of the discharge lamp is detected by the OFF state detector and the DC input voltage lying off the predetermined range is detected by the DC input voltage detector, and permitting power supply to the discharge lamp upon reception of a signal indicating that the DC input voltage has returned within the predetermined range.

With the above arrangement, power supply to the discharge lamp is inhibited when the OFF status of the discharge lamp is detected and a DC input voltage is out of a predetermined range. When a variation in battery voltage is temporary and the DC input voltage returns within the predetermined range later, power will be supplied again to the discharge lamp. Accordingly, the lamp will not be kept off by a temporary change in battery voltage, and the power supply will be maintained as long as the lamp is lit to thereby keep the ON state of the lamp, thus providing improved safety in driving at night and preventing driving at night at the expense of the safe driving considering circuit protection too much.

BRIEF DESCRIPTION OF THE DRAWINGS

FIGS. 1 through 7 illustrate an embodiment of a lighting circuit for a vehicular discharge lamp of the present invention;

FIG. 1 is a circuit block diagram illustrating the general circuit configuration;

FIG. 2 is a circuit diagram showing a power supplying system;

FIG. 3 is a circuit diagram mainly showing a lighting control system;

FIG. 4 is a circuit diagram mainly showing a low voltage reset circuit and an overvoltage detector;

FIG. 5 is a graph schematically showing changes in currents and voltages of individual circuit sections and a change in the flux of lamp light, with passage of time, for explaining the control operation;

FIG. 6 is a graph illustrating the relation between the output voltage and output current of a DC voltage booster circuit;

FIG. 7 is a diagram illustrating the operation of the low voltage reset circuit.

DETAILED DESCRIPTION OF THE PREFERRED EMBODIMENT

Figure 2:
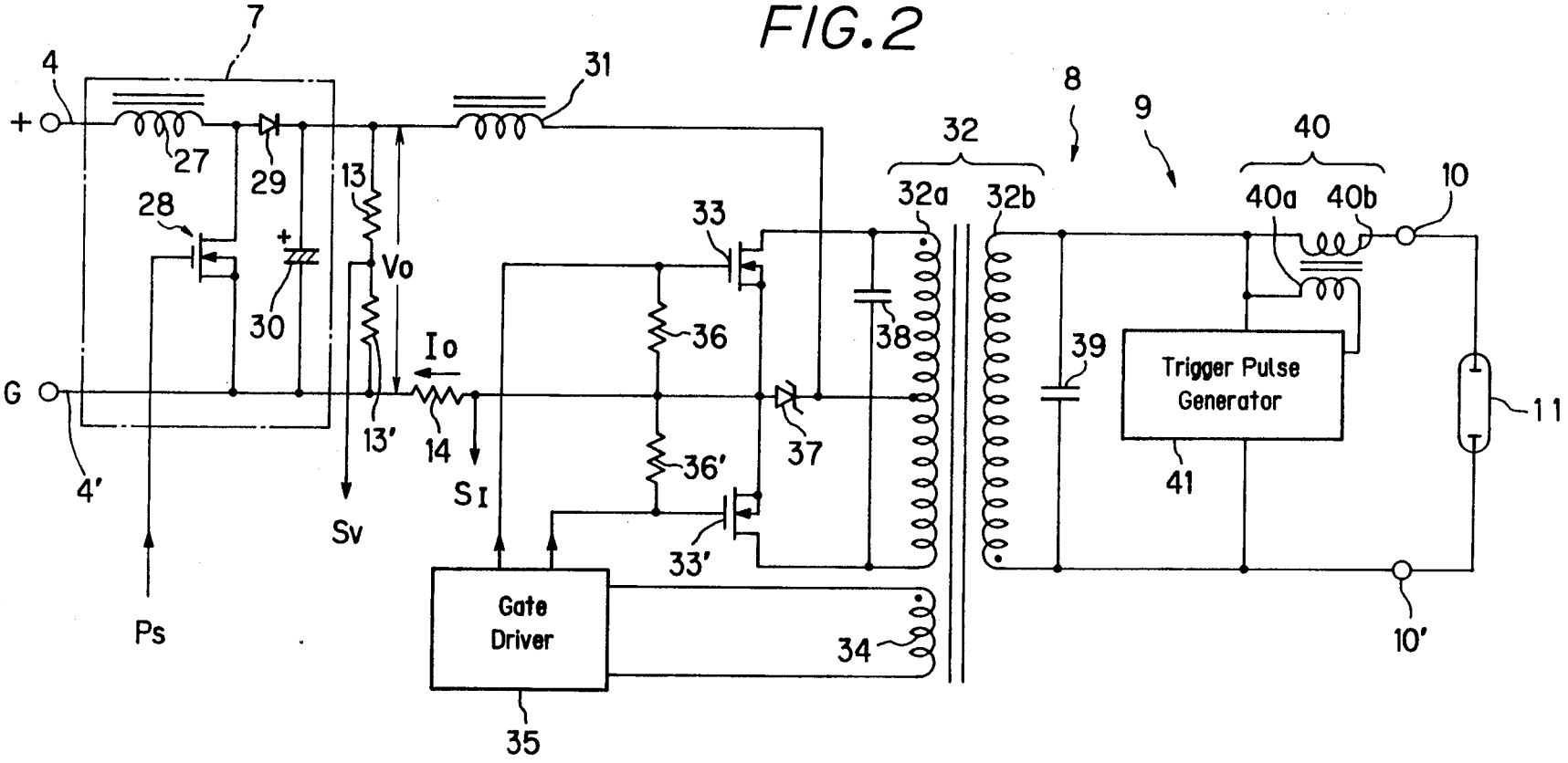

A preferred embodiment of a lighting circuit for a vehicular discharge lamp will now be described in detail, with reference to the accompanying drawings.

General Structure [FIG. 1]

A lighting circuit 1 will be divided into three sections, a power supplying system, a lighting control system and a circuit protecting system, which will be described below system by system.

Power Supplying System

Reference numerals "4" and "4'" denote DC power lines.

The power supplying system of the lighting circuit 1 includes a battery 2, connected between DC voltage input terminals 3 and 3', a lighting switch 5, provided on the positive power line 4, a relay contact 6*a*, a DC voltage booster circuit 7, a high frequently booster circuit 8, and an igniter circuit 9.

The relay contact 6*a*, which is provided on the positive power line 4 in series to the lighting switch 5, is open and closed by a power cutoff relay circuit which will be described later.

The DC voltage booster circuit 7 has its positive input terminal connected to the output terminal of the relay contact 6*a*, and the other input terminal (ground side) connected to the DC voltage input terminal 3'. The boosting operation of this booster circuit 7 serving to boost the battery voltage is controlled by a control circuit (to be described later).

The high frequency booster circuit 8 is provided at the subsequent stage of the DC voltage booster circuit 7. The booster circuit 8 converts the DC voltage from the booster circuit 7 into a sinusoidal AC voltage. A self-exciting inverter circuit of a push/pull type may serve as the high frequency booster circuit 8.

The igniter circuit 9 is provided at the subsequent stage of the high frequency booster circuit 8, with a metal halide lamp 11 of rated power of 35 W connected between AC output terminals 10 and 10' of the circuit 9.

Lighting Control System

The lighting control system includes a control circuit 12, a voltage drop detector 18, an ON/OFF state detector 20, and a quiescent period controller 21.

The control circuit 12, which serves to control the output voltage of the DC voltage booster circuit 7, receives a voltage detection signal corresponding to the output voltage $V_o$ of the booster circuit 7 detected by voltage-dividing resistors 13 and 13' provided between the output terminals of the booster circuit 7. The control circuit 12 also receives through an amplifier 15 a current detection signal converted into a voltage by a current-detecting resistor 14 provided on the ground line which connects the booster circuit 7 and the high frequency booster circuit 8. The current detection signal corresponds to the output current $I_o$ of the booster circuit 7. The control circuit 12 generates a control signal $P_s$ according to these detection signals, and it sends the control signal to the DC voltage booster circuit 7 via a gate driver 16 so as to control the output voltage of the circuit 7.

The control circuit 12 further receives the output voltage $V_o$ of the DC voltage booster circuit 7 via a timer circuit 17, so as to ensure transition to constant power control of the lamp upon elapse of a predetermined time period corresponding to turn-OFF time of the lamp after the lighting of the lamp starts.

The voltage drop detector 18 sends a signal to the control circuit 12 when a voltage +B, coming through a diode from the output terminal of the relay contact 6*a* and applied to a power terminal 19, falls below a predetermined level, thereby controlling the lighting of the metal halide lamp 11 by control power smaller than the rated power.

The ON/OFF state detector 20 determines whether or not the metal halide lamp 11 is lit by checking if the output of the amplifier 15 is equal to or greater than a predetermined level. The detector outputs a detection signal $S_{20}$ corresponding to the result of the decision.

The quiescent period controller 21 is involved in the lighting control in a state where the voltage applied to the DC voltage input terminals 3 and 3' falls down to or below a predetermined value. More specifically, the controller 21 determines whether or not the power supply voltage B is equal to or lower than the predetermined value upon reception of an OFF state detection signal $S_{20}$ from the ON/OFF state detector 20. If the voltage B is equal to or lower than the predetermined level, the controller 21 sends a signal $S_{21}$ to the control circuit 12 to restrict the quiescent period of the control pulse $P_s$, thereby varying the upper limit of the output voltage $V_o$ of the DC voltage booster circuit 7. During this period, the controller 21 sends a signal $S'_{21}$; to the voltage drop detector 18 to temporarily stop the operation of the detector 18.

Circuit Protecting System

The circuit protecting system includes a power cutoff relay circuit 6, an abnormality judging circuit 22, a low voltage reset circuit 23, an overvoltage detector 24, a delay/recover circuit 25 and an output current abnormality detector 26.

The power cutoff relay circuit 6 serves to cut off the supply of the battery voltage to circuits located at the subsequent stages upon occurrence of an abnormality in the lighting circuit. That is, upon reception of signals from the abnormality judging circuit 22, low voltage reset circuit 23, overvoltage detector 24 and output current abnormality detector 26, the relay circuit 6 sets its internal relay off to open the aforementioned relay contact 6*a*.

The abnormality judging circuit 22 compares a decision reference value of an output current corresponding to the output voltage $V_o$ of the DC voltage booster circuit 7 with the level of a signal from the amplifier 15 corresponding to the output current of the booster circuit 7. This circuit 22 also determines whether or not the lighting circuit is in an abnormal state from the comparison result, and sends a control signal to the power cutoff relay circuit 6 upon reception of the detection signal $S_{20}$ from the ON/OFF state detector 20. The abnormal states of the lighting circuit may include a lighting abnormality of the metal halide lamp 11 (shorting or open state of the lamp) and a case where the output stage of the high frequency booster circuit 8 is set in an open state. When detecting such an abnormal state of the lighting circuit, the abnormality judging circuit 22 sends a signal to the relay circuit 6 to cut off the power supply to the booster circuit 7 from the battery 2.

The low voltage reset circuit 23 sends a signal to the power cutoff relay circuit 6 through the delay/recover circuit 25 to cut off the supply of the battery voltage to the DC voltage booster circuit 7 when the battery voltage becomes abnormally too low to keep the lighting of the lamp. Such an operation is performed only when the reset circuit 23 is informed of the lamp being in an OFF state by receiving the detection signal $S_{20}$ from the ON/OFF state detector 20. In other words, the reset circuit 23 does not determine whether or not to permit the power supply to the DC voltage booster circuit 7 based only on the level of the battery voltage, but actually determines whether or not to allow the supply of the battery voltage to the power supplying system by checking if the battery voltage is equal to or lower than a predetermined value only after it is informed of the OFF state of the lamp.

The overvoltage detector 24 sends a signal to the power cutoff relay circuit 6 via the delay/recover circuit 25 to cut off the supply of the battery voltage to the power supplying system upon detection of the value of the battery voltage having exceeded a predetermined value.

Upon reception of an abnormality detection signal from the low voltage reset circuit 23 or overvoltage detector 24, the delay/recover circuit 25 promptly sets the relay in the power cutoff relay circuit 6 off to open the contact 6*a*. When the battery voltage returns to the normal range thereafter, this circuit 25 closes the relay contact 6*a* with a predetermined delay time.

The output current abnormality detector 26 is provided for circuit protection when the output current $I_o$ becomes abnormally large due to the output stage of the high frequency booster circuit 8 becoming a short-circuited state or short-circuit occurring in another circuit section. In other words, the abnormality judging circuit 26 receives a detection signal concerning the output current $I_o$ of the DC voltage booster circuit 7 through the amplifier 15, and it determines the occurrence of an abnormality when the output current $I_o$ becomes equal to or greater than a reference value, sending a signal to the power cutoff relay circuit 6 to inhibit the supply of the battery voltage to the booster circuit 7.

The output current abnormality detector 26 always monitors the output voltage $V_o$ of the DC voltage booster circuit 7 to discriminate whether the metal halide lamp 11 is in a state where lighting has just started or in a normal state, and changes a reference value for comparison concerning the output current $I_o$ of the booster circuit 7 according to the decision result.

As described above, the power cutoff relay circuit 6, which determines whether or not to supply the battery voltage to the power supplying system in accordance with signals from the circuits 22, 23, 24 and 26, maintains the power cutoff state in response to an abnormality detection signal originating from a permanent abnormality, such as the signal from the abnormality judging circuit 22 or output current abnormality detector 26 unless the lighting switch 5 is closed again. On the other hand, the circuit 6 does not hold the power cutoff state in response to an abnormality detection signal originating from an temporary cause such as the signal from the low voltage reset circuit 23 or the overvoltage detector 24, in the case of an increase (or reduction) in battery voltage and supplies the power supply voltage again to the power supplying system when the battery voltage returns to the normal level.

Figure 3:
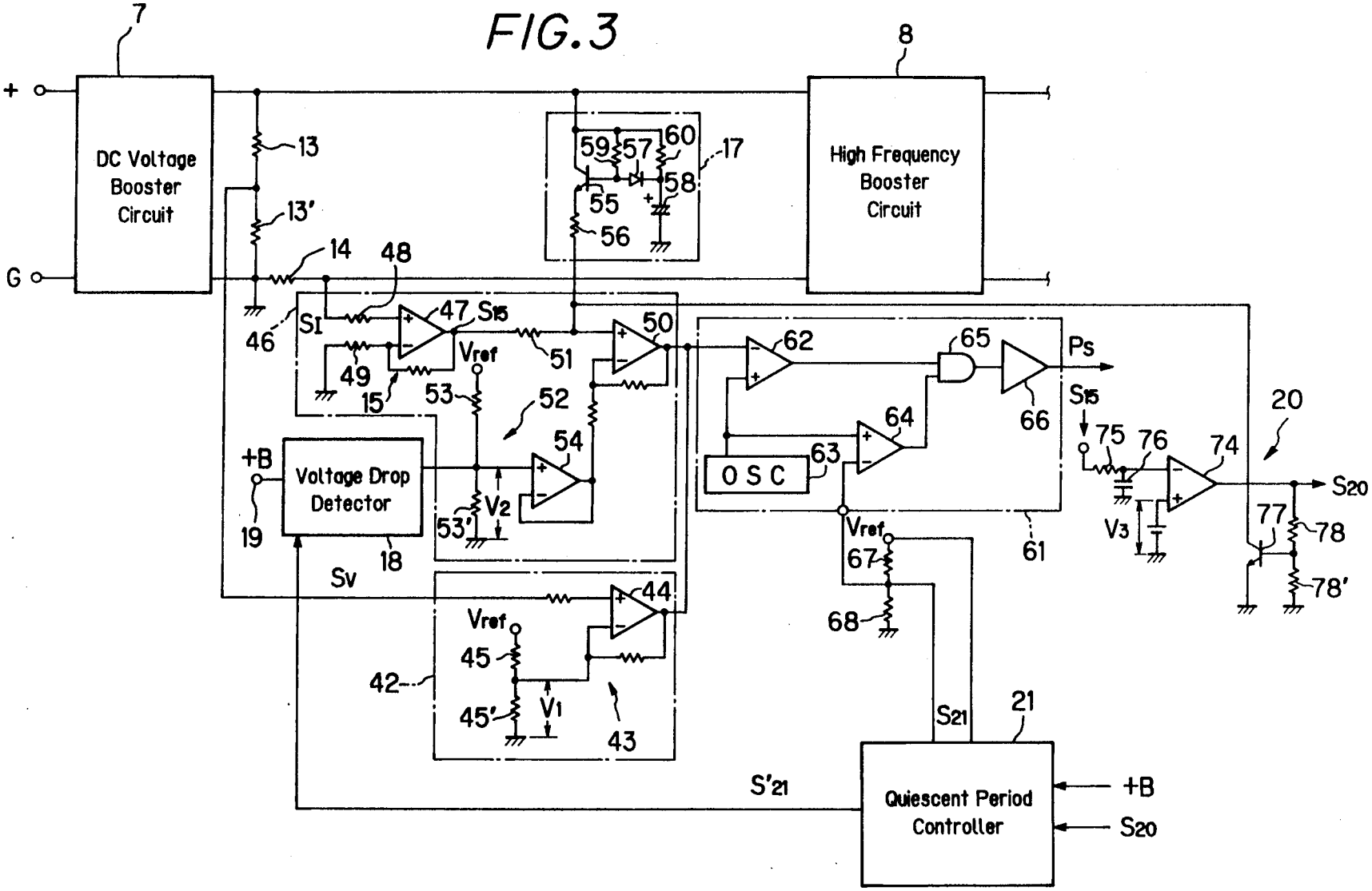
Figure 4:
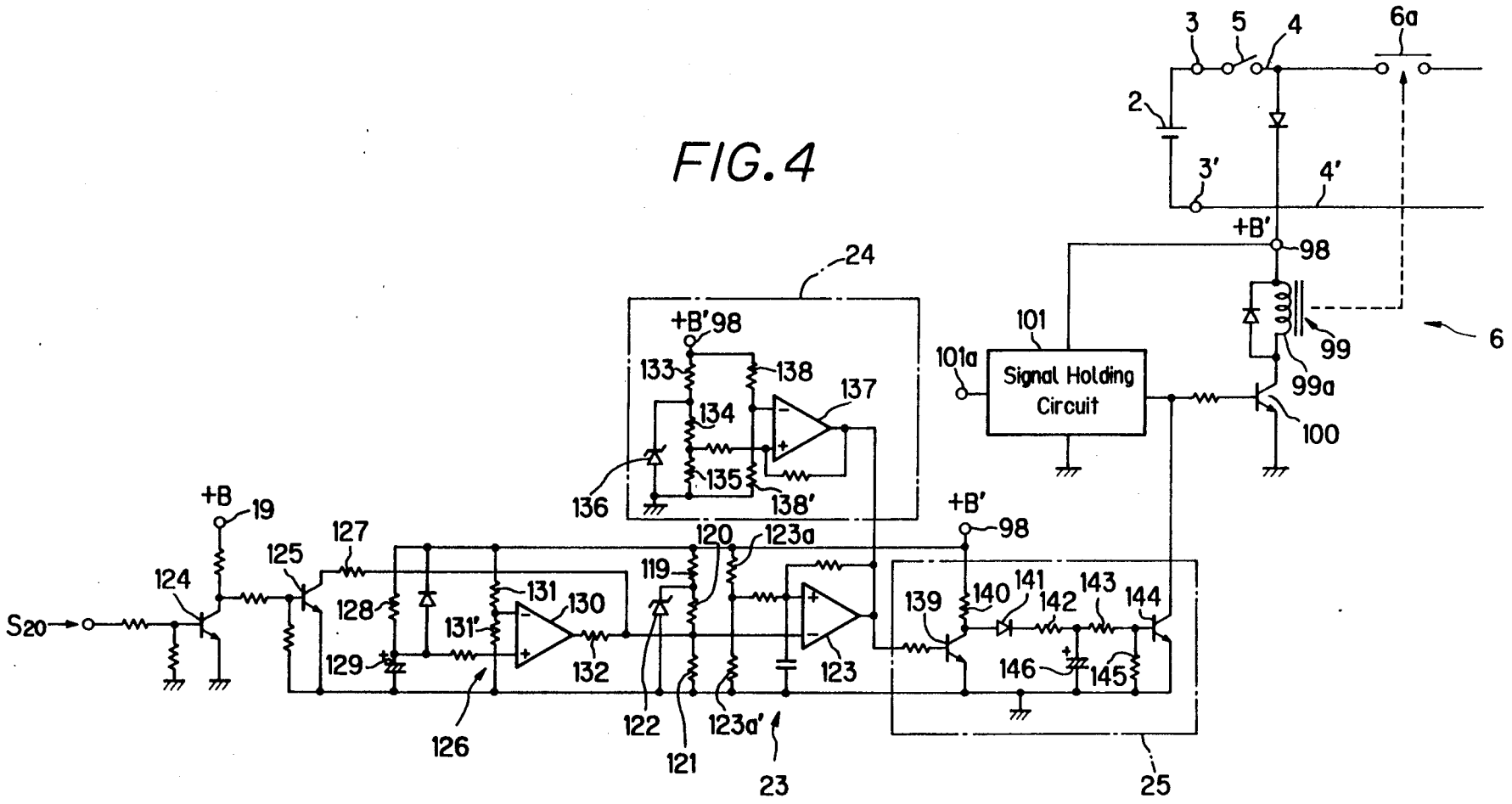

Circuit Constitution of Each Section [FIGS. 2 through 4]

Next, sections constituting the lighting circuit 1 will be described below in detail.

Power Supplying System [FIG. 2]

DC Voltage Booster Circuit

The DC voltage booster circuit 7, constituted as a chopper type DC-to-DC converter, includes an inductor 27 connected to a positive line 4, an N channel field effect transistor (FET) 28, a rectifier diode 29 and a smoothing capacitor 30. The FET 28 is located at the subsequent stage of the inductor 27 and is connected between the positive line 4 and a ground line 4'. The FET 28 performs its switching operation in response to a control pulse Ps sent via a gate driver circuit 16 from the control circuit 12. The rectifier diode 29 has its anode connected to the drain of the FET 28 on the positive line 4. The smoothing capacitor 30 is connected between the cathode of the rectifier diode 29 and the ground line 4'. With the DC booster circuit 7 constituted in the above manner, the inductor 27 stores energy when the FET 28 becomes conductive in response to the control pulse $P_s$, and releases the stored energy, when the FET 28 becomes nonconductive, with the consequent superposition of the corresponding voltage on the input voltage, thereby boosting the DC voltage.

High Frequency Booster Circuit

A self-exciting push/pull type inverter is used as the high frequency booster circuit 8.

The booster circuit 8 includes a choke coil 31, a transformer 32, N channel FETs 33 and 33', a feedback winding 34, resistors 36 and 36', and capacitors 38 and 39 respectively provided on the primary winding side and the secondary winding side of the transformer 32.

The choke coil 31 has its one end connected to the positive output terminal of the DC voltage booster circuit 7 and the other end connected to the center tap of a primary winding 32*a* of the transformer 32.

The N channel FETs 33 and 33' have their sources connected to the one end of the current-detecting resistor 14. The FET 33 has its drain connected to one end of the primary winding 32*a* on the winding-start side, while the other FET 33' has its drain connected to the other end of the primary winding 32*a* on the winding-end side.

The feedback winding 34, provided on the primary winding side of the transformer 32, sends an induced voltage to a two-phase gate driver 35, which produces two drive signals in the opposite phase relation and sends them to the respective FETs 33 and 33'.

The resistor 36 is connected between the gate and source of the FET 33, and the resistor 36' is connected between the gate and source of the FET 33'. A Zener diode 37 is provided between the center tap of the primary winding 32*a* and the common sources of the FETs 33 and 33'.

Condensers 38 and 39 are provided on the side of primary winding and secondary winding of the transformer 32, respectively.

In this high frequency booster circuit 8, switching the FETs 33 and 33' in the opposite directions is executed by a drive signal, generated by the gate driver 35 based on the voltage induced by the feedback winding 34, so as to provide a sinusoidal AC voltage across both ends of the secondary winding 32*b* of the transformer 32.

Igniter Circuit

The igniter circuit 9 comprises a trigger transformer 40 and a trigger pulse generator 41.

The trigger transformer 40 has its secondary winding 40*b* provided on a line connecting one output terminal of the high frequency booster circuit 8 and an AC output terminal 10, and the transformer also has its primary winding 40*a* applied with a pulse from the trigger pulse generator 41.

The trigger pulse generator 41 has a capacitor and a spark gap element (not shown). When the capacitor is charged at the beginning of lighting the lamp and its terminal voltage exceeds a predetermined value, the spark gap element is rendered conductive, generating a trigger pulse. This terminal voltage is boosted by the transformer 40 and superimposed on the AC output of the high frequency booster circuit 8, then it is applied to the metal halide lamp 11.

Lighting Control System [FIG. 3]

With respect to the lighting control system, a description will be given regarding the control circuit 12, timer circuit 17 and ON/OFF state detector 20.

The control circuit 12 comprises an output voltage detector involved in detecting the output voltage $V_o$, an output current detector concerning the detection of the output current $I_o$ and a PWM (Pulse Width Modulation) control section.

Output Voltage Detector

An output voltage detector 42 detects the output voltage $V_o$ of the DC voltage booster circuit 7 through the voltage-dividing resistors 13 and 13', compares the detected voltage with a predetermined reference value, and outputs the voltage difference as an error output.

An operational amplifier 44 includes as an error amplifier 43 having its non-inverting input terminal connected between the voltage-dividing resistors 13 and 13' through a resistor to thereby receive a voltage detection signal $S_v$. The inverting input terminal of the error amplifier 43 is supplied with a predetermined reference voltage $V_1$ specified by voltage-dividing resistors 45 and 45'. To one end of the resistor 45 is applied a predetermined voltage $V_{ref}$ from a reference voltage generator (not shown). This voltage $V_{ref}$ is constant, not influenced by a variation in battery voltage.

Output Current Detector

An output current detector 46 detects the output current $I_o$ of the DC voltage booster circuit 7 as a voltage-converted value through the current-detecting resistor 14, compares the detected value with a predetermined reference value, and outputs the voltage difference as an error output.

The amplifier 15 is constituted by an operational amplifier 47 and a resistor, which are so connected in a negative feedback arrangement. The operational amplifier 47 has its non-inverting input terminal connected via a resistor 48 to one end (on the non-ground side) of the current-detecting resistor 14 to receive a current detection signal $S_I$, and its inverting input terminal grounded through a resistor 49.

An operational amplifier 50 serving as an error amplifier has its non-inverting input terminal connected via a resistor 51 to the output terminal of the operational amplifier 47, and its inverting input terminal is supplied with a reference voltage $V_2$ from a reference voltage generator 52.

The reference voltage generator 52 comprises resistors 53 and 53', which are connected in series, and a voltage buffer 54 which receives the voltage between the resistors 53 and 53'. The output of the voltage buffer 54 is input to the inverting input terminal of the operational amplifier 50 through a resistor. To one end of the resistor 53 is applied voltage $V_{ref}$.

The value of $V_2$ is changed according to a signal that is sent from the voltage drop detector 18 to the reference voltage generator 52 in response to a reduction in power supply voltage B. According to this voltage control, the lamp 11 is controlled based on power equal to or lower than the rated power in accordance with the reduction in battery voltage.

Timer Circuit

The timer circuit 17 is provided to ensure transition to constant power control upon elapse of a time period corresponding to the turn-off time of the lamp after the lighting of the lamp starts. This timer circuit 17 includes an active switch device and a time constant circuit.

An NPN transistor 55 has its collector connected to the positive output terminal of the DC voltage booster circuit 7 and its emitter connected to the non-inverting input terminal of the operational amplifier 50 via a resistor 56.

The transistor 55 has its base connected to the anode of a diode 57 whose cathode is grounded through a capacitor 58 (its electrostatic capacity being denoted by $C_{58}$).

A resistor 59 (having a resistance $R_{59}$) is connected between the base and collector of the transistor 55, and a resistor 60 (having a resistance $R_{60}$) is connected between the cathode of the diode 57 and the collector of the transistor 55.

PWM Control Section

A PWM control section 61 includes a comparator 62, which compares the input voltage with a saw-tooth voltage from an oscillator 63. Based on the comparison result, the PWM control section 61 generates a control pulse $P_s$ having a duty cycle determined according to the input voltage. More specifically, the comparator 62 has its negative input terminal connected to the output terminals of the operational amplifiers 44 and 50 and its positive input terminal connected to the output terminal of the oscillator 63.

A comparator 64 for controlling the quiescent period is provided to control the quiescent period of the control pulse $P_s$ to thereby determine the upper limit of the output voltage $V_o$ of the DC voltage booster circuit 7. (This upper limit is denoted by "$V_m$" which is not a fixed value but can be changed by the quiescent period controller 21.) The comparator 64 is designed in such a manner that with a signal from the oscillator 63 supplied to its positive input terminal, increasing the voltage applied to the other, negative input terminal makes the quiescent period of the pulse from the comparator 64 longer.

An AND circuit 65 performs an AND operation on the output pulses from the comparators 62 and 64, and sends the comparison result via a buffer 66, providing the final control pulse $P_s$.

The AND circuit 65 therefore selects that of the output pulses of the comparators 62 and 64 which has a smaller duty cycle.

The negative input terminal of the comparator 64 is normally applied with a voltage $V_{ref}$ acquired by voltage-dividing a reference voltage by voltage-dividing resistors 67 and 68. This negative input terminal is, however, applied with a voltage with difference values by the signal $S_{21}$ produced from the quiescent period controller 21 in accordance with the operational condition of the circuit. As a result, the allowable range (the upper limit $V_m$) of the output voltage $V_o$ of the DC voltage booster circuit 7 is changed.

In short, the duty cycle of the control pulse $P_s$ acquired by the PWM control section 61 is specified in accordance with the output voltages of the output voltage detector 42 and the output current detector 46, and the upper limit of this duty cycle of the pulse $P_s$ is determined by the level of the voltage applied to the negative input terminal of the comparator 64. The control pulse $P_s$ is fed back through the gate driver 16 to the FET 28 of the booster circuit 7 whereupon the output voltage $V_o$ is controlled.

ON/OFF State Detector

The negative input terminal of a comparator 74 is connected via a resistor 75 to the output terminal of the amplifier 15, and receives the output $S_{15}$ from the amplifier 15. The positive input terminal of the comparator 74 is applied with a predetermined reference voltage "$V_3$".

The comparator 74 compares the output voltage $S_{15}$ from the amplifier 15 and the reference voltage $V_3$, and outputs a signal $S_{20}$ as a comparison result. With the lamp on, as the level of the output voltage $S_{15}$ is equal to or greater than the reference voltage $V_3$, the comparator 74 outputs a low (L) signal as the signal $S_{20}$. With the lamp Off, as $S_{15}$ is below $V_3$, the comparator 74 outputs a high (H) signal as the signal $S_{20}$.

A capacitor 76 is located between the negative input terminal of the comparator 74 and the ground line.

An NPN transistor 77 has its emitter grounded, its base supplied with a voltage acquired by voltage-dividing the output voltage of the comparator 74 by resistors 78 and 78', and its collector connected to the non-inverting input terminal of the operational amplifier 50 in the output current detector 46. When the output signal from the comparator 74 becomes H level, therefore, the transistor 77 is turned on, forcing the electric potential of the non-inverting input terminal of the operational amplifier 50 to be reduced close to zero.

Circuit Protecting System [FIG. 4]

Power Cutoff Relay Circuit

A power supply terminal 98 is connected via a reverse voltage protecting diode to the terminal on the output side of the lighting switch 5. A voltage supplied to this power supply terminal 98 is referred to as "+B'".

A relay 99 has a coil **99*a* with one end connected to the power supply terminal 98 and the other end connected to a collector of an NPN transistor 100. The contact 6*a* is open or closed according to presence or absence of the excitation operation of the coil 99*a***.

A signal holding circuit 101 receives signals at its input terminal **101*a* from the abnormality judging circuit 22 and the output current abnormality detector 26. When the input terminal 101*a* becomes an H level, holding this level, the transistor 100** is turned off.

As a result, the relay 99 is turned off, and the power supply to the DC voltage booster circuit 7 is cut off. This status should continue unless the lighting switch 5 is set on again after it has been temporarily set off.

When an abnormality concerning the battery voltage is detected, the base of the transistor 100 receives an L signal through the delay/recover circuit 25 from the low voltage reset circuit 23 or the overvoltage detector 24, turning off the transistor 100 and setting the relay 99 off. When the battery voltage returns to the normal range, the H signal from the delay/recover circuit 25 renders the transistor 100 on, and the relay 99 closes the contact **6*a***, restarting the lighting operation.

Low Voltage Reset Circuit

The low voltage reset circuit 23 includes a resistor 119, a Zener diode 122 and a comparator 123.

The resistor 119 has its one end connected to the power supply terminal 98 and the other end grounded through resistors 120 and 121.

The Zener diode 122, connected in parallel to the resistors 120 and 121, has its cathode connected between the resistors 119 and 120 and its anode grounded.

The comparator 123 has its negative input terminal connected between the resistors 120 and 121, and its positive input terminal is supplied via a resistor with a voltage obtained by voltage-dividing the voltage applied to the power supply terminal 98 by means of voltage-dividing resistors **123*a* and 123*a'***.

More specifically, a reference voltage of the comparator 123 is produced by the resistors 119 to 121 and Zener diode 122; the comparator 123 outputs an L signal when the power supply voltage B' voltage-divided falls below this reference voltage.

Such a detecting operation is executed only when the lamp is an OFF state, and is not done when the lamp is lit or until a predetermined period of time elapses after closing the lighting switch 5.

There are two-staged NPN transistors 124 and 125 (both having the emitters grounded), which perform the switching operation according to the signal $S_{20}$ from the ON/OFF state detector 20, and a delay circuit 126 including a capacitor and a comparator.

The signal $S_{20}$ from the ON/OFF state detector 20 is supplied via a resistor to the base of the transistor 124 whose collector voltage is applied via a resistor to the base of the transistor 125 having the collector connected via a resistor 127 to the negative input terminal of the comparator 123.

When the signal $S_{20}$ is an L signal, the transistor 124 is turned off and the transistor 125 on, lowering the potential at the negative input terminal of the comparator 123. This enforces the output of this comparator 123 to be an H signal, inhibiting an operation concerning the detection of dropping of power supply voltage. In other words, such a detecting operation is performed only when the signal $S_{20}$ is an H signal.

A resistor 128 in the delay circuit 126 has one end connected to a power terminal 98 and the other end grounded via a capacitor 129. The terminal voltage of the capacitor 129 is applied via a resistor to the positive input terminal of a comparator 130.

To the negative input terminal of the comparator 130 is applied a voltage acquired by voltage-dividing the power supply voltage B' by voltage-dividing resistors 131 and 131'. An output signal of the comparator 130, corresponding to the result of the comparison between this applied voltage and the terminal voltage of the capacitor 129, is sent via a resistor 132 to the negative input terminal of the comparator 123.

In other words, the output of the comparator 130 has an L level signal during a period (for approximately 0.2 second) in which the charging of the capacitor 129 starts immediately after closing the lighting switch 5 and the terminal voltage of the capacitor exceeds a reference voltage (3.5 V), so that the output of the comparator 123 is forced to be an H signal.

Overvoltage Detector

A resistor 133 has one end connected to the power terminal 98 and the other end grounded via resistors 134 and 135.

A Zener diode 136 has its cathode connected between the resistors 133 and 134 and its anode grounded.

A comparator 137 has its positive input terminal connected via a resistor between the resistors 134 and 135. The negative input terminal of the comparator 137 is applied with a voltage acquired by voltage-dividing the power supply voltage B' by resistors 138 and 138'.

That is, when the battery voltage is high and the potential at the negative input terminal of the comparator 137 exceeds a reference voltage produced by the resistors 133 to 135 and Zener diode 136, the overvoltage detector 24 outputs an L signal.

Delay/Recover Circuit

An emitter-grounded NPN transistor 139 has its base supplied with a signal from the low voltage reset circuit 23 or overvoltage detector 24 through a resistor, and performs the switching operation in response to this signal.

The collector of the transistor 139 is connected to the power terminal 98 through a resistor 140 and to the base of an NPN transistor 144 through the diode 141 and resistors 142 and 143.

The transistor 144 has its collector connected via a resistor to the base of the transistor 100, with a resistor 145 provided between the base and emitter of the transistor 144.

A capacitor 146 has one end connected between the resistors 142 and 143 and the other end grounded.

In this delay/recover circuit 25, when at least one of the output signals of the low voltage reset circuit 23 and overvoltage detector 24 is an L signal, the transistor 139 is turned off, immediately rendering the transistor 144 on. As a result, the transistor 100 is turned off, setting the relay 99 off. When the output signals of the low voltage reset circuit and the overvoltage detector 24 have an H level signal thereafter, the transistor 139 is turned on, and the transistor 144 will be turned off, not immediately, but after elapse of a predetermined period of time by the time constant circuit comprising the resistors 143 and 145 and capacitor 146.

Figure 5:
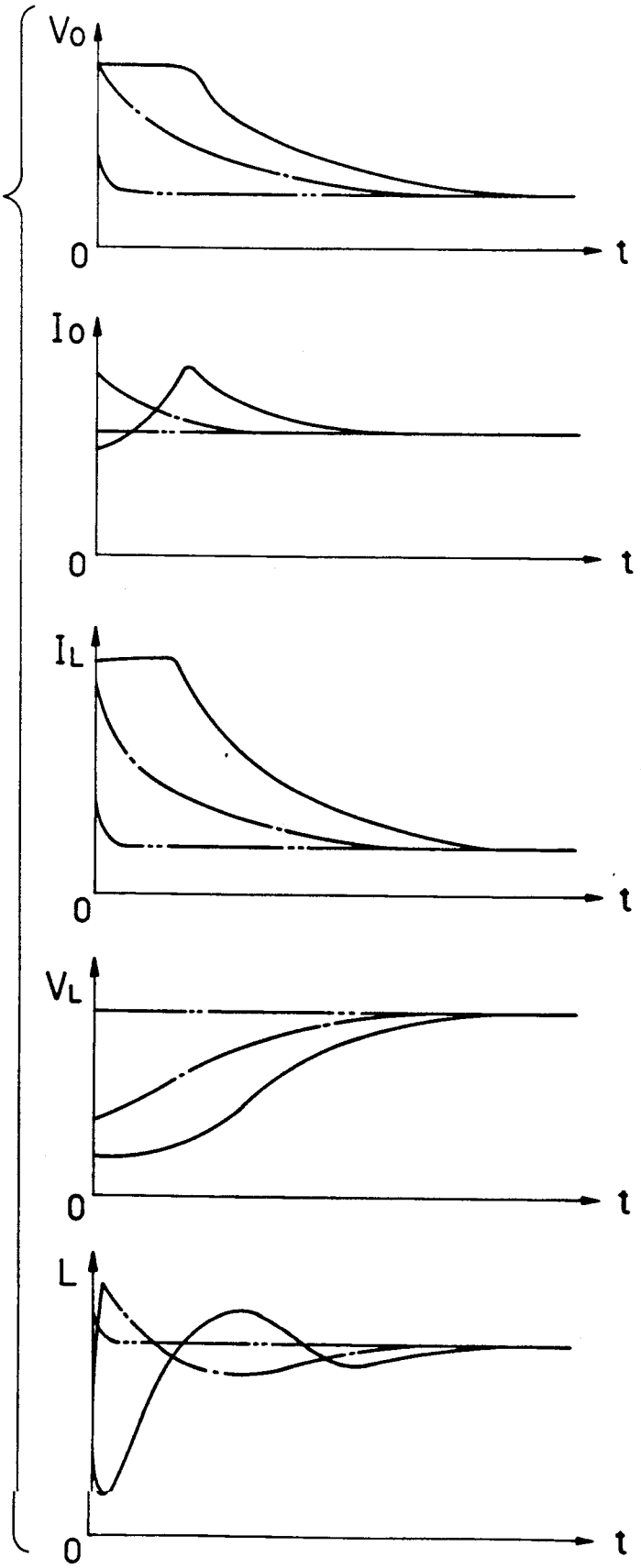
Figure 6:
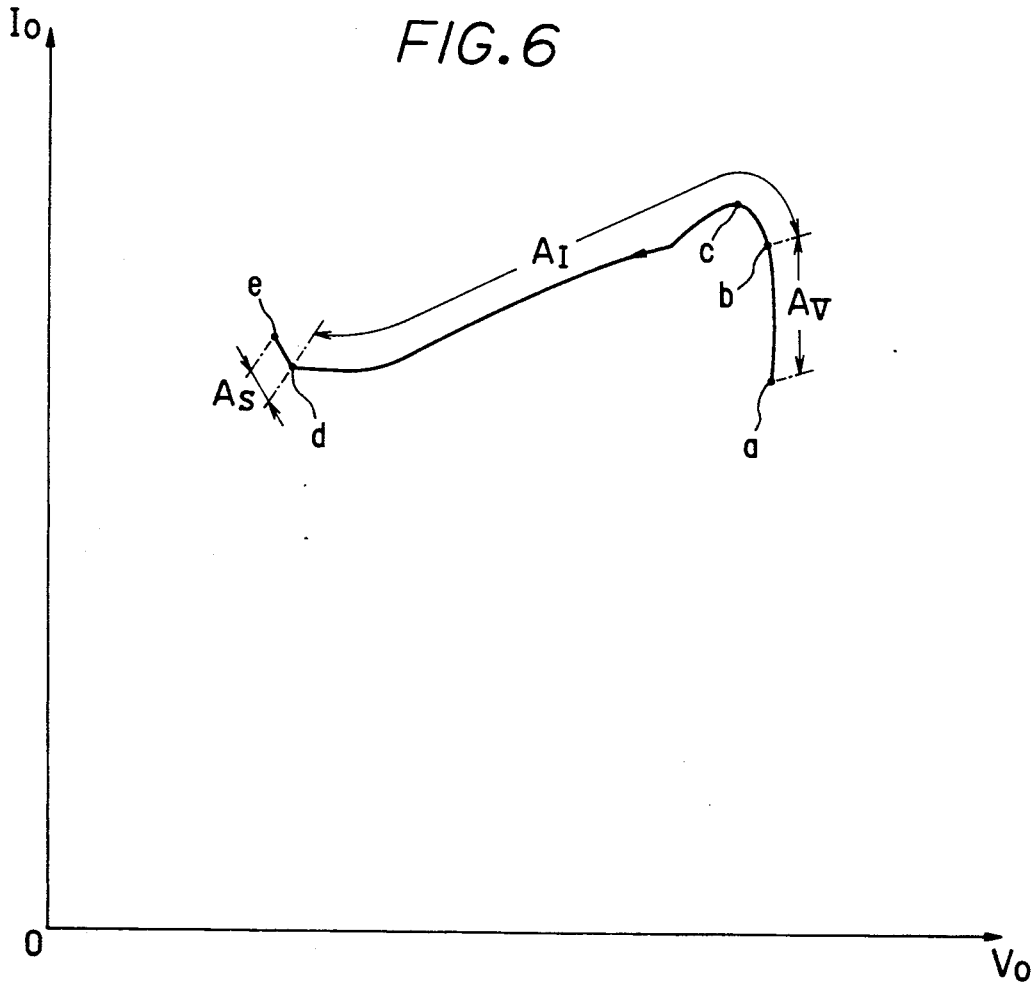
Figure 7:
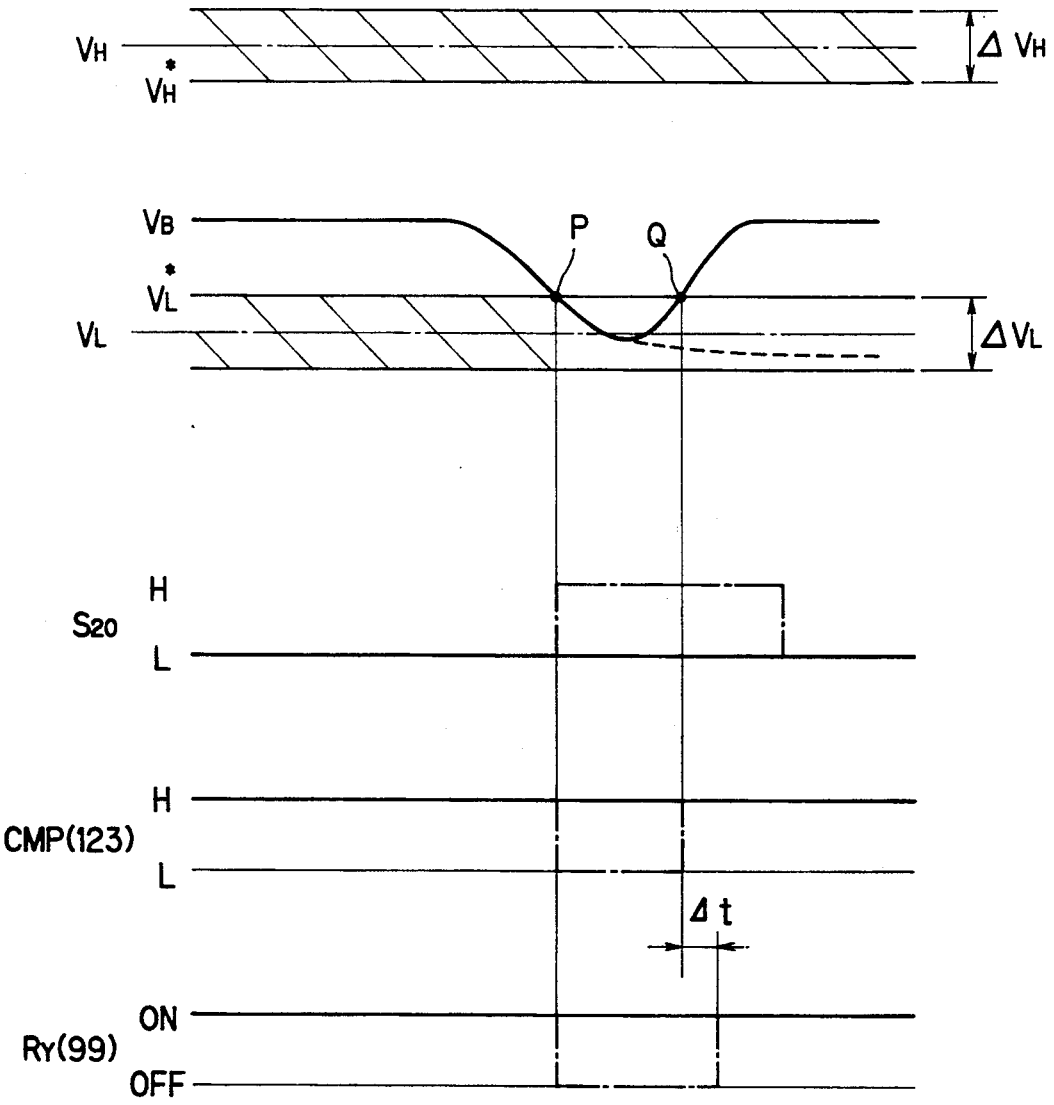

Operation [FIGS. 5 through 7]

The operation of the lighting circuit 1 includes a lighting control operation for the metal halide lamp 11 and a circuit protecting operation, which will separately be described below in the named order.

FIG. 5 schematically illustrates changes in the output voltage $V_o$ (V) and output current $I_o$ (A) of the DC voltage booster circuit 7, the lamp current $I_L$ (A), the lamp voltage $V_L$ (V) and the flux of light, L ( m) from the metal halide lamp 11 with passage of time. The origin of the time axis t corresponds to the time at which the light switch 5 is closed. FIG. 6 presents a graph illustrating the relation between the output voltage $V_o$ taken on the horizontal axis and the output current $I_o$ taken on the vertical axis.

Lighting Control Operation [FIGS. 5 through 6]

The lighting control operation of the lighting circuit 1 will now be described with reference to the case where the voltage between the DC voltage input terminals 3 and 3' is in a normal range.

First, a description will now be given regarding the environment at the time of cold starting at which the lighting of the lamp starts from the cold state of the lamp.

In this case, immediately after closing the lighting switch 5, the capacitor 58 of the timer circuit 17 is uncharged and the emitter potential of the transistor 55 is low. Accordingly, only the output of the amplifier 15 is applied to the noninverting input terminal of the operational amplifier 50 in the output current detector 46.

Immediately after the lamp is lit, however, as should be clear from the solid-line curve in FIG. 5, the lamp voltage $V_L$ is low, and the output current $I_o$ of the DC voltage booster circuit 7 is relatively small.

In other words, the output $S_{15}$ of the amplifier 15 is smaller than the reference voltage $V_2$ from the reference voltage generator 52.

While the lamp is not lit, $S_{15}$ is smaller than $V_3$ so that the output signal of the ON/OFF state detector 20 is an H level signal and the transistor 77 is turned on, forcibly rendering the input voltage of the operational amplifier 50 to an L level.

During a period of time from the point of closing the lighting switch 5 to the point of detecting the lighting of the lamp, the duty cycle of the control pulse $P_s$ is determined by the input voltage of the quiescent-period adjusting comparator 64, i.e. a voltage acquired by voltage-dividing the reference voltage $V_{ref}$ by the resistors 67 and 68; this obtained voltage determines the upper limit of the Output voltage $V_o$ of the DC voltage booster circuit 7.

When the lighting of the lamp is detected thereafter, the duty cycle of the control pulse $P_s$ is determined by the output voltage of the error amplifier 43 of the output voltage detector 42, and this control pulse $P_s$ is sent through the gate driver 16 to the FET 28 of the DC voltage booster circuit 7 from the PWM control section 61.

The point "a" in FIG. 6 indicates the state immediately after the lighting of the lamp starts. A control region $A_v$ from the point "a" to the point "b" to which the output current $I_o$ gradually increases, with the output voltage $V_o$ being approximately constant, is under the control of the output voltage detector 42.

Then, as the capacitor 58 is gradually charged, the emitter potential of the transistor 55 increases and the potential at the non-inverting input terminal of the operational amplifier 50 increases. Given that the time constant at this time is $\tau_1$, then $\tau_1=(R_{59}//R_{60})\cdot C_{58}$, where "//" represents a parallel summation of the resistance.

When the potential reaches the level corresponding to the reference voltage $V_2$, the duty cycle of the control pulse $P_s$ is determined by the output voltage of the operational amplifier 50.

That is, as the duty cycle of the control pulse $P_s$ decreases with an increase in output voltage of the operational amplifier 50, the output voltage $V_o$ which has been held at a maximum, gradually decreases.

With regard to the reference voltage $V_2$, when the battery voltage is equal to or greater than a predetermined value, for example, 10 V, the reference voltage $V_2$ is determined by a voltage acquired by voltage-dividing $V_{ref}$ by the resistors 53 and 53'.

A control region $A_I$ from the point "b" to the point "d" in FIG. 6 passing through the peak point "c" of the output current $I_o$ is controlled by the output current detector 46.

When the capacitor 58 becomes fully charged, the transistor 55 is turned ON and its emitter potential nearly equals the output voltage $V_o$ of the booster circuit 7. Thereafter, the control transits to the constant power control mode.

That is, since control is executed in such a way that the sum of the output voltage $V_o$ voltage-divided by the resistors 51 and 56 and the amplified output $S_{15}$ corresponding to the output current $I_o$ becomes a constant value corresponding to $V_2$, constant power control is realized in the form of a linear approximation, with $V_o \cdot I_o$ being constant.

A region $A_s$ from the point "d" to the point "e" in FIG. 6 is a constant power region where the rated power is supplied to the metal halide lamp 11.

Thus, the flux L of light from the lamp rises steeply, immediately after the light is lit and it shifts to the normal state after going through an overshoot.

A description will now be given regarding the operation for lighting the metal halide lamp 11 again after it has been temporarily turned off.

During a time when the lamp is turned off, the charge stored in the capacitor 58 in the timer circuit 17 is gradually discharged with a time constant $\tau_2(=R_{60} \cdot C_{58})$. This time constant $\tau_2$ is determined according to the degree of reduction in temperature of the lamp after it is turned off. When the lighting switch 5 is closed again, therefore, the lighting operation starts from the control region corresponding to the terminal voltage of the capacitor 58.

That is, proper lighting control is performed in accordance with the elapsed time required for relighting the lamp after it has once been turned off.

For instance, in a case where the lamp is lit again after several tens of seconds have elapsed after the lamp has been previously turned off, the lighting of the lamp starts from the operational point in the control region $A_I$ and the control mode changes to constant power control. Therefore, the output voltage $V_o$ and output current $I_o$ gradually decrease from the beginning of the lighting of the lamp, as shown by respective one-dot chain lines in FIG. 5, and the flux L of light from the lamp rises sharply at the beginning and becomes stable after going through an overshoot.

In a case where the metal halide lamp 11 is lit again after it is temporarily turned off for several seconds, the glass bulb of the lamp 11 is still hot. As should be clear from curves indicated by the two-dot chain lines in FIG. 5, the lamp voltage $V_L$, immediately after the relighting of the lamp 11, is high and the output current $I_o$ is high, thereby causing a shift to constant power control, whereupon the flux L becomes stable at the rated power.

The timer circuit 17 is provided to shorten the start time. That is, if the timer circuit 17 were not provided and the output voltage $V_o$ of the DC voltage booster circuit 7 directly applied to the non-inverting input terminal of the operational amplifier 50 via the resistor 56, constant power control would be executed from the beginning of the lighting of the lamp irrespective of the physical conditions of the lamp, so that the light emission from the lamp would not progress through the control region $A_v$ or $A_I$. This would delay the rising of the flux L of light.

Circuit Protecting Operation

A description will be given below regarding the circuit protecting operation in a case where an abnormality of the lighting circuit 1 is detected.

Operation of Low Voltage Reset Circuit

Figure 8:
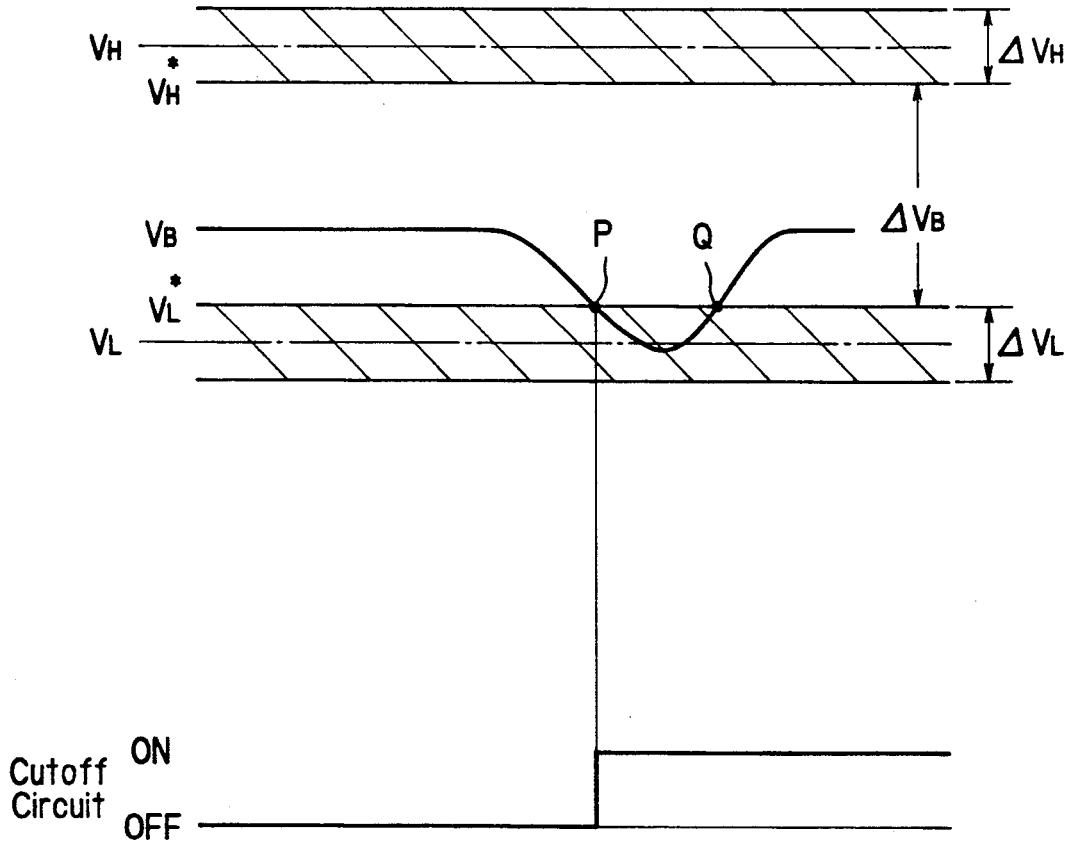
FIG. 8 is a diagram showing a power cutoff operation of the prior art when a battery voltage drops.

FIG. 7 shows the relation between a variation in battery voltage $V_B$ and signals and operational statuses of individual sections. "$V_L$", "$\Delta V_L$", "$V^*_L$", "$V_H$", "$\alpha V_H$", and "$V^*_H$" are as already described with reference to FIG. 8.

Below the battery voltage $V_B$ in FIG. 7 are the level (H/L) of a lamp-OFF detection signal $S_20$, the level (H/L) of the output signal of the comparator 123 (referred to as "CMP(123)"), and the operational status of the relay 99 (referred to as "$R_y$(99)" represented by a binary state, ON or OFF).

The low voltage reset circuit 23 is so designed as to detect reduction in the input voltage B' when and only when the circuit 23 receives the lamp-OFF detection signal from the ON/OFF state detector 20.

When the detection signal $S_{20}$ has an L level as indicated by the solid line (i.e., when the lamp is turned on), although the battery voltage $V_B$ falls below the point P, $V_B = V^*_L$, the output signal of the comparator 123 keeps an H level. This is because the reference voltage of the comparator 123 has dropped since the transistor 124 is turned off and the transistor 125 is turned on. The transistor 139 is therefore turned on by the H signal from the comparator 123, and the transistor 144 is turned off. Accordingly, the relay 99 is in an ON status and the relay contact 6a is closed.

When the level of the signal $S_{20}$ is high (H) at the point P as shown by the one-dot chain line, i.e., when the lamp is turned off, the transistor 124 is turned on, turning off the transistor 125 located at the subsequent stage. In this case, the reference voltage of the comparator 123 is determined by the resistors 119, 120 and 121 and the Zener diode 122.

The comparator 123 detects the input voltage B' lower than the reference value, outputting an L-level signal.

The delay/recover circuit 25 therefore has the transistor 139 turned off and the transistor 144 immediately turned on. This renders the transistor 100 in the power cutoff relay circuit 6 on, setting the relay 99 off and its contact 6a open as a consequence.

If the battery voltage $V_B$ stays at or below $V^*_L$ even after passing the point P as indicated by the broken line, the relay contact 6a will be kept open. If the drop of the battery voltage $V_B$ is just temporary so that $V_B$ becomes equal to $V^*_L$ at the point Q as shown by the solid line, then returns to the range of $V^*_L \leqq V_B \leqq V^*_H$, the comparator 123 outputs an H-level signal at the point Q.

The voltage at the points P and Q are set at the same level in FIG. 7 for easier understanding of the operation of the low voltage reset circuit. However, the comparator 123 actually has a hysteresis characteristic because, with regard to detecting the drop of the voltage B', the comparator 123 does not directly detect the output voltage of the battery 2, but detects an input voltage applied between the DC voltage input terminals 3 and 3', or the battery voltage minus the voltage drop caused by the current consumption in the battery. Unless the comparator 123 has the hysteresis characteristic with respect to the detection level, a kind of chatter would occur in the relay 99.

Actually, it is preferable that the relay 99 is set OFF when the OFF status of the lamp is detected with $V_B$ equal to or lower than about 7.5 V, and that the relay 99 is rendered ON when $V_B$ returns to or above approximately 9.5 V. The hysteresis characteristic of the comparator 123 is also effective for a variation in battery voltage ($V_B$=5 to 8 V) which will be caused at the time the engine of an automobile is started by the cell starter.

If the width of the hysteresis characteristic is set to the above range, the relay 99 undesirably remains OFF when the lighting switch 5 is set on with $V_B$=8 V, for example. To avoid this problem, the delay/recover circuit 25 serves to temporarily hinder the detection of the drop of the voltage B' until a predetermined time elapses immediately after the switch 5 is turned on.

When the output of the comparator 123 becomes an H level, the transistor 139 is immediately turned on. But, the transistor 144 is turned off when the terminal voltage of the capacitor 146 becomes equal to or below a predetermined value. The delay time during this period (hereafter referred to as "Δt") is set to a value (for example, Δt=0.15 sec) that satisfies the following two conditions:

(1) In the case that the spontaneous power cutoff is intermittently repeated in accordance with the vibration of a vehicle originating from improper connection of the connector (or the contact) connecting the battery terminal to the DC voltage input terminals 3 and 3', cut off the power supply continually during this period.

(2) When the ON/OFF operation of the lighting switch is repeated as in the case of passing, switch the power supply on or off in accordance with this ON/-OFF operation.

In the case (1), since spontaneous power cutoff or power ON is repeated, the capacitor 146 is gradually charged, turning on the transistor 144, while the output of the comparator 123 has an L level. Once the transistor 144 is on, however, even the repetitive spontaneous power cutoff and power ON will not turn the transistor 144 off, because the time constant Δt, determined by the resistors 143 and 145, and the capacitor 46, is large.

The requirement (2) is to permit the power supply to be switched on or off in accordance with the speed of the switching operation by the driver. In this case, the capacitor 146 is not sufficiently charged while the power ON and power cutoff are repeated.

When the output signal of the comparator 123 becomes an H level, the transistor 144 is turned off Δt sec later, and the transistor 100 is turned on, rendering the relay 99 in an ON state. As a result, the relay contact 6a is closed, so that the operation to light the lamp 11 restarts, lighting the lamp 11 when a certain period of time passes from the point P.

Operation of Overvoltage Detector

When the power supply voltage B' becomes an overvoltage and the potential at the negative input terminal of the comparator 137 exceeds the reference voltage, the L signal from the comparator 137 is sent to the transistor 139 of the delay/recover circuit 25, immediately opening the relay contact 6a.

When the voltage B' decrease to the normal range thereafter, the output signal of the comparator 137 becomes an H signal, and the relay contact 6a is closed after a predetermined delay time is elapsed after this H signal is input to the delay/recover circuit 25.

Action

Even if the signal from the low voltage reset circuit 23 is sent through the delay/recover circuit 25 to the transistor 100 of the power cutoff relay circuit 6, setting the relay 99 OFF, it does not mean that this state is held. This can therefore eliminate the need for a troublesome operation of the driver's switching off the lighting switch 5, then switching it on again to release the power cutoff state.

Further, if the battery voltage falls down to or below $V^*_L$, the relay 99 remains ON when the lamp 11 is lit, thus supplying the battery voltage to the DC voltage booster circuit 7.

In other words, the power supply to the lamp 11 is permitted even when battery voltage drops, as long as the lamp 11 is kept on. The allowable range $\Delta V_B$ for voltage variation in this case is broader than $V^*_H$-$V^*_L$. (The range $\Delta V_B$ in the prior art is $\Delta V^*_H$-$\Delta V^*_L$, irrespective of the ON/OFF status of the lamp.)

Therefore, even when the battery voltage $V_B$ falls below the lower limit $V^*_L$, the low voltage reset circuit 23 keeps supplying power as long as the lamp 11 remains on to thereby permit the lamp-ON state to continue as long as possible.

Although only one embodiment of a lighting circuit for a vehicular discharge lamp has been described herein, it should be apparent to those skilled in the art that the present invention may be embodied in many other specific forms without departing from the spirit or scope of the invention. That is, the present embodiment is to be considered as illustrative and not restrictive and the invention is not to be limited to the details given herein, but may be modified within the scope of the appended claims. For instance, although the power cutoff circuit is located at the preceding stage of the DC voltage booster circuit, it is possible to provide a circuit which inhibits power supply to the discharge lamp when the oscillation of the high frequency booster circuit is stopped. Although, in the above-described embodiment, a reduction in battery voltage is detected when the OFF status of the lamp is detected, this design may also be applied to the case of detecting the overvoltage from the battery.

What is claimed is:

1. A lighting circuit for a vehicular discharge lamp for lighting a discharge lamp using a DC power supply, comprising:

an OFF state detector for detecting an OFF status of a discharge lamp;

a DC input voltage detector for detecting whether or not a DC input voltage is within a predetermined range; and a power cutoff means for inhibiting power supply to the discharge lamp when the OFF status of the discharge lamp is detected by the OFF state detector and the DC input voltage lying off the predetermined range is detected by the DC input voltage detector, and permitting power supply to the discharge lamp upon reception of a signal indicating that the DC input voltage has returned within the predetermined range.

2. A lighting circuit according to claim 1, wherein the power cutoff means includes:

a relay connected to a DC voltage booster circuit; and a signal holding circuit having an input terminal connected an the abnormality judging circuit and a output current abnormality detector, for holding a predetermined status of said input terminal to render the relay off to thereby cut off power supply to the DC voltage booster circuit.

3. A lighting circuit according to claim 1 or 2, wherein the DC input voltage detector comprises a low voltage reset circuit for outputting an output signal to the power cutoff means to inhibit power supply to the DC voltage booster circuit when the voltage to the DC voltage booster circuit drops to or below a first predetermined level.

4. A lighting circuit according to claim 3, further comprising an overvoltage detector for outputting an output signal to the power cutoff means to inhibit power supply to the DC voltage booster circuit when the voltage to the DC voltage booster circuit exceeds a second predetermined level.

5. A lighting circuit according to claim 1, wherein the DC input voltage detector includes a comparator having a hysteresis characteristic.

6. A lighting circuit according to claim 5, further comprising a delay/recover circuit.

7. A lighting circuit according to claim 1, further comprising an abnormality judging circuit for comparing a value of an output current of a DC voltage booster circuit with a first reference value to determine whether or not the lighting circuit is in an abnormal state.

8. A lighting circuit according to claim 1, further comprising an output current abnormality detector for comparing the value of a current detection signal with a second reference value to determine occurrence of an abnormality, and, upon judging that the abnormality has occurred, sending a signal to that effect to the power cutoff means to inhibit power supply to the DC voltage booster circuit.

9. A lighting circuit according to claim 1, further comprising:

a voltage drop detector; and a control means, connected to the DC voltage booster circuit, for controlling the output voltage of the lighting circuit in accordance with a current detection signal concerning the output current of the DC voltage booster circuit and a voltage detection signal concerning the output voltage of the DC voltage booster circuit.

10. A lighting circuit according to claim 9, further comprising a quiescent period controller, connected to the OFF state detector, for determining whether or not a power supply voltage to the DC voltage booster circuit is equal to or lower than a predetermined value upon reception of an OFF state detection signal from the OFF state detector.

* * * * *